United States Patent [19]

Block

[11] 3,960,097

[45] June 1, 1976

[54] HIGH SPEED GEARLESS FABRIC PULLER

[75] Inventor: Charles Block, North Bellmore, N.Y.

[73] Assignee: Joseph Galkin Corporation, Hicksville, N.Y.

[22] Filed: June 3, 1974

[21] Appl. No.: 475,810

Related U.S. Application Data

[63] Continuation-in-part of Ser. No. 346,070, March 29, 1973, Pat. No. 3,886,878.

[52] U.S. Cl. ..... 112/214

[51] Int. Cl.[2] ..... D05B 27/10

[58] Field of Search ..... 112/121.26, 121.27, 112/211, 214

[56] References Cited

UNITED STATES PATENTS

| | | | |
|---|---|---|---|
| 2,037,088 | 4/1936 | Plamondon | 112/214 |
| 2,231,648 | 2/1941 | Weis | 112/121.26 |
| 3,083,658 | 4/1963 | Winberg | 112/214 |
| 3,141,428 | 7/1964 | Reeber et al. | 112/211 |

FOREIGN PATENTS OR APPLICATIONS

| | | | |
|---|---|---|---|
| 528,684 | 11/1940 | United Kingdom | 112/121.26 |

*Primary Examiner*—George H. Krizmanich
*Attorney, Agent, or Firm*—Paul J. Sutton

[57] ABSTRACT

The present invention includes a high-speed, relatively low-inertia, gearless, synchronized puller attachment for cooperative use with fabric sewing, handling and fastening machines, or the like. In the case of sewing machine applications, uniform stitch repeatability is achieved through the provision of top and bottom pulling rollers that are each positively driven at high speeds through anti-reversing means positioned relatively near the needle side of the sewing machine. Little, if any, output inertia is present, thereby permitting high-speed indexing without braking means being necessary. A novel adjustable linkage provides a reliable and substantially equal angular displacement of both pulling rollers in a harmonic motion synchronized both as between said pulling rollers as well as the sewing machine feed.

15 Claims, 7 Drawing Figures

FIG. 4
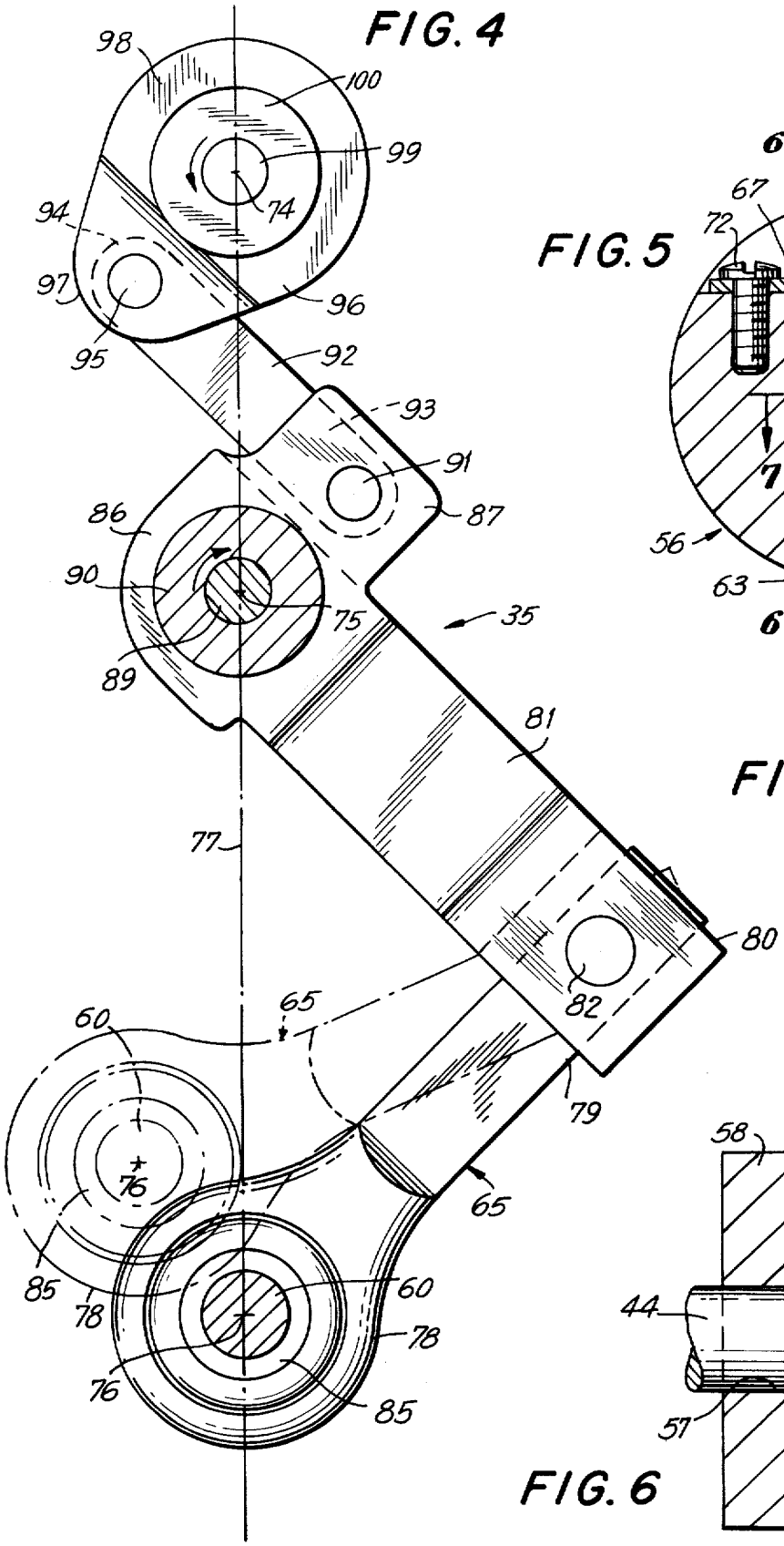
FIG. 5
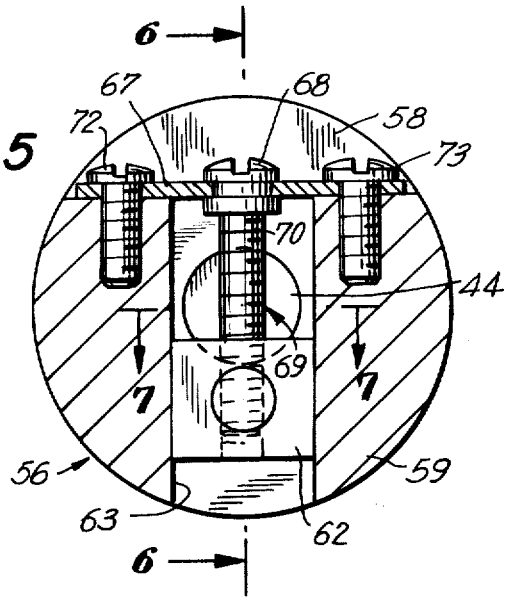
FIG. 7
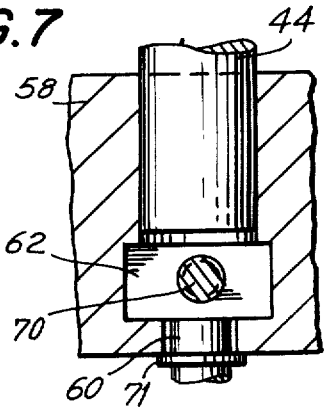
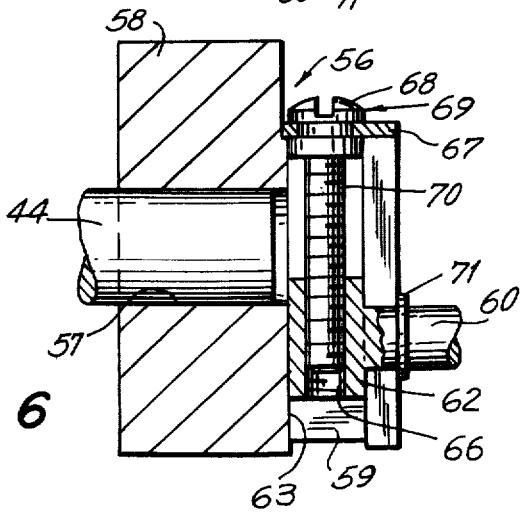
FIG. 6

HIGH SPEED GEARLESS FABRIC PULLER

This is a continuation-in-part patent application of my co-pending U.S. Patent application Ser. No. 346,070, filed Mar. 29, 1973 now U.S. Pat. No. 3,886,878 and entitled AUTOMATIC FABRIC HANDLING APPARATUS and, as to subject matter common to both, an effective filing date on Mar. 29, 1973 is respectfully sought.

The present invention relates generally to fabric handling apparatus including and/or associated with sewing machines, or the like, and more particularly to fabric pulling apparatus, attachments and methods of aiding the sewing and handling of fabrics.

The industrial sewing machine industry has consistently sought ways by which to increase both sewing speeds as well as the speeds with which fabrics can be handled. Higher speeds — with higher product output — will result in higher profits. Leaders in generating novel labor-saving attachments and apparatus include the New York based Joseph Galkin Corporation, as evidenced by the many patented devices, attachments and methods used in the marketplace.

However, a specific area contemplated by the present invention has remained somewhat neglected. I refer to the pulling (to taking up or taking the slack out) of fabric that has been joined by thread and the sewing machine needle. Unless a predetermined or desired tension is maintained in sewn fabric after it has left the needle, stitch uniformity is next to impossible to achieve. This is especially so when joining multiple layers of fabric or cloth and the problem becomes acute when employing relatively higher sewing speeds.

Yes, sewing aids of various types have been utilized on industrial sewing machines for more than four decades. These include what has become known in the trade as "pullers" or pulling rollers which serve the purpose of acting as an extra pair of hands to assist the machine operator in removing sewn fabric from the needle in a manner that will result in constant fabric tension. Uneven fabric tension in different layers to be joined is quite undesirable. It results in fabric misorientation due to slippage between adjacent layers of cloth which, in turn, causes non-uniform stitch sizes. Conventional pullers include upper and lower (top and bottom) rollers which contact the fabric that has been sewn, but which are not independently or jointly driven. The aforementioned slippage between fabric layers, as well as slippage between the rollers, is a common phenomenon.

As a result of problems associated with pullers known to the art, machine operators must be relatively highly skilled. Whereas the conventional puller has been helpful in that it aids the operator in moving fabric away from the needle, the skill of the operator is yet still required to attempt to keep constant tension in all layers of multi-layered fabric only whose bottommost layer is urged forward by the sewing machine feed dog. The reader should quickly appreciate the plight of the soft goods manufacturer whose operators' individual sewing characteristics will and must vary. The problem is compounded when the finished goods incorporate decorative stitch patterns that rely upon stitch size repeatability for their design appearance. The more highly skilled the machine operator staff, the higher the more highly skilled the machine operator staff, the higher the weekly payroll such that solutions to these problems have become counterproductive.

The evolution of fabric pullers has included various attempts to solve the basic problem associated with sewing multiple layered fabrics on conventional sewing machines, namely — only the bottommost layer of cloth is driven, thereby requiring operator skill in guiding and pulling the respective layers so as to prevent slippage and disorientation. The advent of the "synchronized" puller represented a major step forward in achieving more uniform stitch repeatablity. Synchronized pullers include upper and lower rollers which should be driven at the same times and fabric speeds as those of the feed dog.

A typical conventional geared top and bottom roller-driven synchronized puller attachment is shown in FIG. 1 mounted on the rear side of an overlock-type sewing machine. The reader will note that the machine operator is normally positioned facing the opposite hidden front side of the sewing machine shown in FIG. 1, however the particular view chosen best illustrates the locations and inter-relationships between the structural features of this device. A more detailed description of the prior art device shown in FIG. 1 is given below, however reference to FIG. 1 will reveal the placement of a drive clutch, its output members and various gear box elements — all located on the same side of the sewing machine as its handwheel (shown on the left side of FIG. 1 but normally on the machine operator's right-hand side during use).

The conventional arrangement of geared elements shown in FIG. 1 presents yet another problem overcome by the present invention. A considerable inertia load is created by the placement of elements such as the shafts, gears, universal and clutch at a distance from the puller rollers. The addition of braking to the output cam, for example, many reduce some of the inertia-caused overshooting produced by this arrangement during deceleration, but adds to the loading on both the clutch and the sewing machine on acceleration. The result is a machine known to the art in which inertia as a result of this geared arrangement of elements prevents accurate and reliable stitch repeatability.

Conventional puller devices of the type used with industrial sewing machines, such as the type illustrated in FIG. 1, have considerable limitations and disadvantages. The puller roller forces are usually transmitted from the sewing machine handwheel at one end (the right side of the machine operator) of the industrial sewing machine through shafts, eccentrics and levers to the opposite or needle-end of the sewing machine. These transmitted forces drive the lower roller in the case of many conventional applications. One does not need much of an imagination to realize that there is a considerable amount of inertia in such a transmission arrangement. This consistently causes the undesirable phenomenon of what is commonly referred to as "overshooting" at relatively higher machine speeds. The result of this phenomenon is often a pulling of the materials being sewn, thereby altering the sizes of the stitches placed in the same garment. In addition to elongated or varying stitching at various points in the same garment, this overshooting will also often result in a tearing of the material being sewn as a result of the material being pulled against both the needle and the feed dog of the industrial sewing machine with which the conventional puller arrangement is associated. To make matters even worse, rather complex adjustments are required when machine strokes are altered, thereby reducing the effective time that the machine is in use.

The result of these limitations and disadvantages has produced a growing need for a puller arrangement capable of accommodating machine speeds of 6,000 to 8,500 stitches per minute (SPM), as opposed to maximum conventional speeds of 4,500 stitches per minute (SPM) in the type of arrangement shown in FIG. 1. There is also a need for an arrangement which will facilitate lifting or separating the upper roller from the lower roller in the puller without causing interference among gears and without changing either the stroke position or angle. This is not possible in conventional geared arrangements.

We thus see that attempts to solve prior art problems associated with the joining and handling of multiple-layered fabrics, for example, have resulted in apparatus which themselves include limitations and disadvantages. Accordingly, it is an object of the present invention to provide a puller attachment assembly for synchronous use with a sewing machine, or the like, which is relatively inexpensive to produce and which will operate relatively, efficiently at and in synchronous response to relatively high machine speeds.

Another object of the present invention is to provide a puller attachment assembly, as aforesaid, which is gearless.

Yet another object of the present invention is to provide a puller attachment assembly, as aforesaid, which possesses relatively low inertia characteristics which, in turn, are aided by the disposition of novel combinations of structural elements at, near and substantially adjacent the needle end of the sewing machine (or like) to which same is mounted.

Another object is to provide a relatively low-cost puller attachment capable of very rapidly being mounted upon a conventional sewing machine by a relatively unskilled person, thereby and thereafter giving the user of the sewing machine a remarkable and substantial increase in machine output, together with reliable stitch repeatability.

Still another object is to provide a puller attachment, as aforesaid, for use with fabric handling and fabric treating devices other than industrial sewing machines.

A further object is to provide a sewing machine which includes a puller assembly with incorporates and exhibits the novel features and elements to be described below.

Yet a further object of this invention is to provide a puller attachment assembly, as aforesaid, which permits high-speed indexed motion without braking means and which includes, without limitation, the driving of upper and lower rollers in synchronized harmonic motion with the sewing machine feed drive means.

The present invention fulfills the above-listed objectives, as well as many others as specifically set forth above, and overcomes the limitations and disadvantages of prior art solutions to conventional problems by providing, in one embodiment of this invention, a puller attachment for use with fabric handling apparatus such as an industrial sewing machine, or the like. The reader's attention is specifically and expressly directed to the fact that, while the present invention will hereinafter be described for and in terms of an industrial sewing machine of the type referrred to, the present invention contemplates a puller attachment and pulling apparatus for use with other types of fabric handling apparatus. In addition, my invention is capable of use as an independent pulling device — not merely as an attachment for use with other apparatus, but an independently driven puller capable of exhibiting the characteristics hereinafter described and set forth in more detail.

The puller attachment according to this invention comprises and includes roller means for receiving fabric made of a plurality of layers of cloth, for example, which has been sewn and discharged by the operation of the needle and feed dog of an industrial sewing machine. The roller means includes upper and lower cooperative rollers which, upon receiving the sewn fabric just mentioned, urge said fabric in a forward direction to be either discharged from the puller attachment into a collecting device, or toward other apparatus not contemplated by the present invention, which may perform further sewing or handling functions.

Puller drive means synchronously and positively driven through a timing belt with respect to the feed drive of said industrial sewing machine synchronously causes substantially identical angular displacement or movement of the upper and lower rollers, respectively, substantially only during periods wherein the industrial sewing machine is in operation. The drive means according to one embodiment of this invention includes a linkage assembly described in more detail below which is disposed relatively adjacent and is cooperatively interconnected with the upper and lower rollers comprising the roller means. One-way clutch means are also included in the drive means for permitting angular displacement of said upper and lower rollers in only one rotary direction each during the sewing and pulling operations.

In another preferred embodiment of the present invention, a flexible shaft drive comprises at least a portion of the drive means abovementioned. In either case the drive means is synchronously driven intermittently in a harmonic motion during one-half the machine cycle. The result is opposite rotational displacement or movement of the upper and lower rollers in harmonic motion during half this cycle in synchronism with respect to one another as well as with respect to the sewing machine feed drive mechanism.

This invention will be more clearly understood from the following description of specific embodiments of the invention, together with the accompanying drawings, wherein similar reference characters denote similar elements throughout the several views, and in which FIG. 1 is a perspective representation of a conventional sewing machine equipped with a puller attachment known to the art;

FIG. 4 is an enlarged elevational representation of the linkage assembly illustrated in FIGS. 2 and 3;

FIG. 5 is an enlarged sectional view of a split clamp locking collar assembly according to the present invention and partially shown in FIGS. 2 and 3;

FIG. 6 is a fragmentary sectional view looking along the line 6—6 of FIG. 5; and FIG. 7 is a fragmentary sectional view looking along line 7—7 of FIG. 5.

Figure 1:
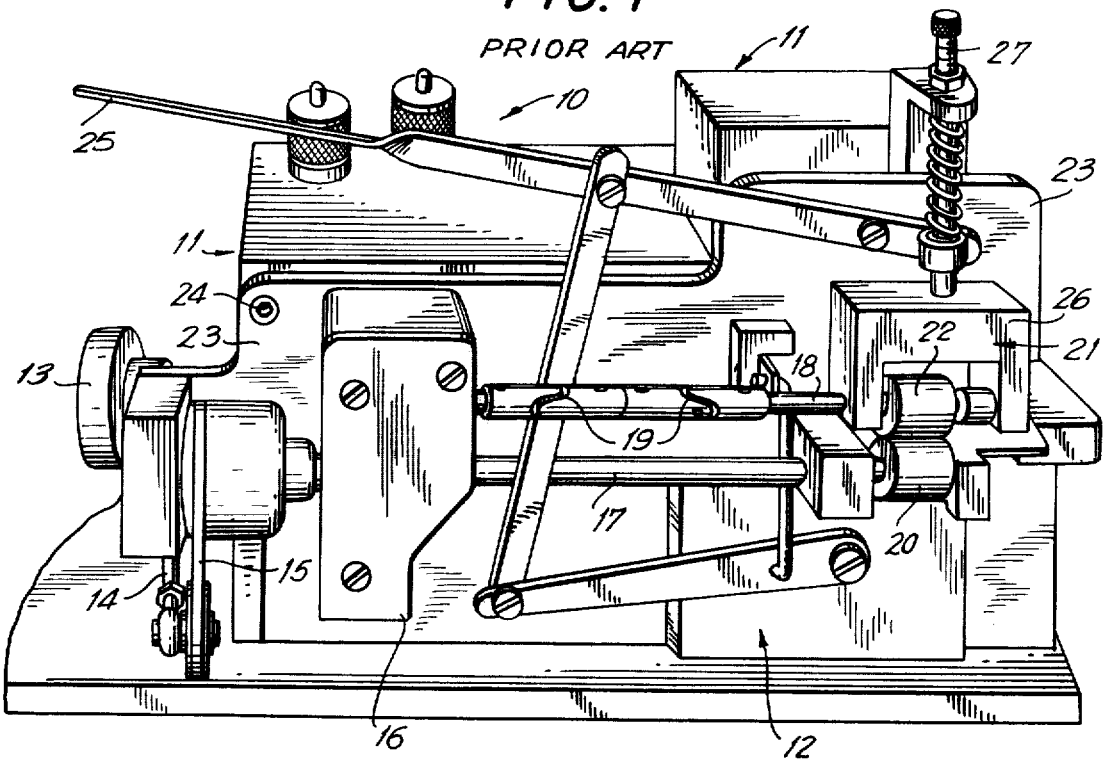
FIG. 1 PRIOR ART

Referring now in more detail to the drawings, the reader's attention is directed firstly to FIG. 1 which is labeled "prior art" for the reason that a known or conventional pulling arrangement is illustrated therein. While every nut and bolt is not specifically shown, an attempt has been made to illustrate the basic elements of a known puller attachment mounted upon an industrial sewing machine of the type sought to be aided by the present invention described in more detail below. Reference character 10 has been used in FIG. 1 to define a complete equipped industrial sewing machine assembly which includes the sewing machine 11 itself shown with a conventional puller attachment 12 mounted upon its rearward side. To the left of the reader a machine handwheel 13 is shown located in its normal position, which is on the right-hand side of the sewing machine operator during use of the illustrated apparatus. The linkage 14 of an adjustable eccentric arrangement, not specifically shown, is illustrated as being interconnected with a one-way or infinite-type ratchet clutch assembly 15, in turn, interconnected with a gear box 16. Gear box 16 contains a conventional internal gear arrangement which usually includes a plurality of spur gears.

Two shafts leave gear box 16, namely — a lower shaft 17 which may be journalled at its respective ends, as well as an upper shaft 18 shown in FIG. 1 as including two universal joints 19 along its length. Lower shaft 17 interconnects the gears of gear box 16 with a lower roller 20 of a roller assembly 21. Upper shaft 18 interconnects the gears within gear box 16 with upper roller 22 of this same roller assembly 21. The ratchet clutch assembly 15, the gear box 16, together with its associated roller and upper shafts 17 and 18, and the roller assembly 21 with its lower and upper rollers 20 and 22 are all supported by or mounted upon a mounting plate 23 by means of conventional fasteners such as socket-headed bolts 24.

The existence of universal joints 19 within the length of upper shaft 18 facilitates the raising of upper roller 22 from and apart from lower roller 20. This is accomplished by means of lever 25 and its associated linkage. By depressing lever 25, roller 22 and its supporting yoke 26 are raised so that the machine operator is able to remove, replace or adjust fabric from or between upper and lower rollers 22 and 20, respectively. Threaded adjustments in adjusting screw assembly 27 facilitates varying pressure between upper and lower rollers 22 and 20, respectively.

As has been suggested above, the output rotation of upper and lower rollers 22 and 20, respectively, must be adjustable to exactly duplicate the machine feed. One-way clutches, such as that contained in ratchet clutch assembly 15, are most often used to transmit the motion from an eccentric driven rocker arm to the output or upper and lower rollers 22 and 20, respectively. Adjustment is achieved by adjusting the effective eccentricity or distance off-center of the eccentric and/or the effective length of the adjustable rocker arm linkage 14.

Note in FIG. 1 the presence or disposition of the ratchet clutch assembly 15 and its associated gear box 16, together with the output shafts on the handwheel side of sewing machine 11. This results in the shafts, gears, universal joints and power rollers being part of the inertia load which will cause the overshooting phenomenon already described. Adding supplementary braking to the output of this mechanism may cut down somewhat on the overshooting during deceleration due to inertia, but only adds to the loading on the clutch as well as on the machine itself.

Other puller arrangements have evolved over the years and the reader is directed to U.S. Pat. No. 2,692,568 in the name of Joseph Galkin to see prior art or conventional-type puller attachment or puller arrangements. While this prior art patent in no way anticipates the novel structural arrangement taught by the present invention, the reader will appreciate the art we are involved with here by looking at the drawing of U.S. Pat. No. 2,692,568, wherein a puller feed carrier attachment is disclosed. One of the principal or primary reasons for the structure disclosed in this Galkin patent is to provide a mechanism capable of installation on a die cast sewing machine frame to facilitate alignment and coaction with the lower roller thereof when operating on uneven surfaces. In this mechanism, the roller movement is cooperatively tied to the feed-dog mechanism of the sewing machine.

Yet another attempt to provide a removable adapter plate and unitary feed roller mounting for sewing machines having auxiliary feed rollers is disclosed in U.S. Pat. No. 2,706,457 in the name of Joseph Galkin.

Let us look now at the structure comprising the present invention. The reader's attention is directed to FIGS. 2 and 3 of the annexed drawings wherein a puller attachment assembly shown in these drawings has been generally designated reference character 30. Puller attachment assembly 30 is capable of a removably secured to fabric handling apparatus such as, for example, overlock sewing machine 31. Once again, as has been done before, I wish to emphasize the ability of my puller attachment assembly to be used on or associated with devices and mechanisms other than a sewing machine. In any case, puller attachment assembly 30 includes a mounting plate 32 which supports various components and elements and which is secured, in this preferred embodiment, by means of fasteners such as bolts 33 to sewing machine 31. There are many different types of sewing machine in the marketplace and it is contemplated by this invention to provide a puller attachment assembly which may be rapidly and easily cooperatively secured to any one of a number of these machines.

Figure 2:
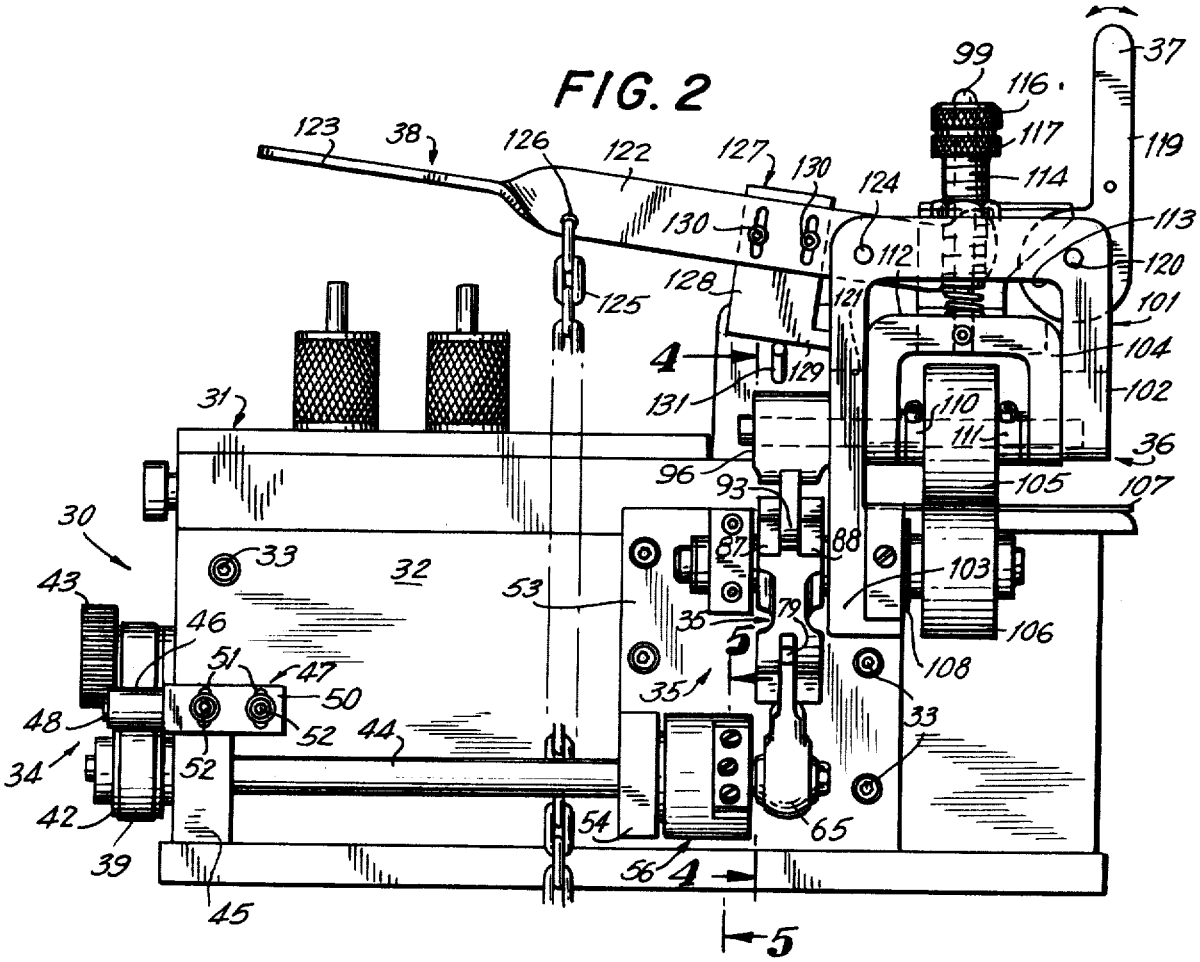
FIG. 2 is a fragmentary elevational view of a puller attachment assembly according to the present invention mounted upon the rearward side of a conventional industrial-type sewing machine.
Figure 3:
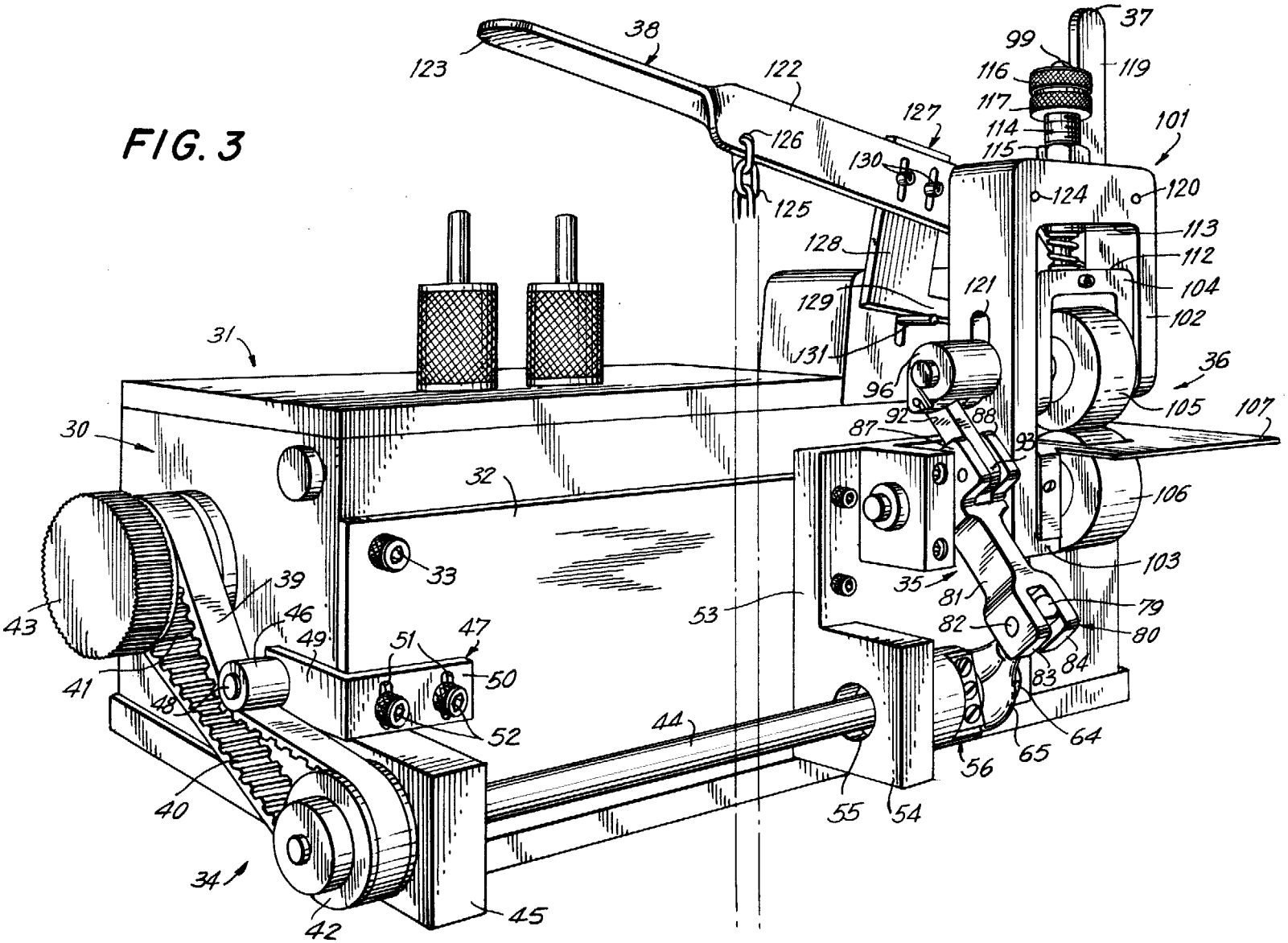
FIG. 3 is a fragmentary perspective view of the apparatus according to a preferred embodiment of the present invention.

It is a feature of this invention to provide a subassembly in the form of puller attachment assembly 30 that is capable of being removably secured to an industrial sewing machine, such as of the type represented by the sewing machine designated reference numeral 31 in FIGS. 2 and 3. Several different interacting and cooperative elements are first mounted upon mounting plate 32 before the entire puller attachment assembly 30 is easily and rapidly secured to the "host" machine, perhaps after being stored and ready for use for a predetermined or desired period.

The puller attachment assembly 30, itself, comprises a number of what will herein be described as assemblies. I refer, for example to puller drive assembly 34 which is positively and synchronously driven through a timing belt by the feed drive means of sewing machine 31. Thereafter, puller drive assembly 34 transmits forces through a shaft 44 supporting driven pulley 42 and journalled in a projecting member 45 integral with plate 32, to a linkage assembly 35. Linkage assembly 35, in turn, transmits these drive forces in a novel manner to a roller assembly 36 located adjacent the needle position of the machine 31. Both a fixed cam lifter 37 as well as a sewing foot lifter 38 are supported or carried by mounting plate 32. Let us now look in more detail at each of these assemblies, their component parts or elements and their interaction with one another.

The perspective view illustrated in FIG. 3, taken with FIG. 2, best illustrates the make-up of drive assembly 34. A flexible gear-toothed timing belt 39 formed with internal gear teeth 40 cooperatively and positively interconnects a sprocket wheel mounted upon the machine feed drive shaft and driven pulley 42. There is a one-to-one (1:1) ratio between the diameters of sprocket wheel 41 and driven pulley 42 such that identical relative angular displacement is maintained as between both. Sprocket wheel 41 is located immediately inside machine handwheel 43. The primary purpose for the existence of flexible timing belt 39 is simply to synchronously transmit the rotary forces associated with sprocket wheel 41 directly to driven pulley 42.

The tension in flexible geared timing belt 39 is adjustably maintained by means of a bearing roller 46 which is rotatably connected to and extends substantially normally from support angle plate 47. Roller 46 is journalled upon a fixed pin 48 secured to leg 49 of angle plate 47. Leg 50 of angle plage 47 is integral with leg 49 and is formed with a pair of elongated and vertically extending slots 51 capable of receiving the shanks of bolts 52. Bolts 52 extend through slots 51 and into threaded engagement with tapped holes (not shown) in mounting plate 32 such that, upon their being loosened either by hand or preferably by wrench, angle plate 47 with its associated bearing roller 46 may easily be positioned and re-positioned to provide the user with a predetermined or desired timing belt tension that will best give results without heating up or unnecessarily stressing other members. However, one is able to see that a rather efficient synchronous transmission of power is effected by use of geared timing belt 39.

A plate 53 is formed with a right-angled projection 54, best seen in FIG. 3, which is formed with a hole 55 extending centrally therethrough. Shaft 43 extends from projecting member 45 through hole 55 and into engagement with an adjustable, split clamp locking collar 56.

The structural details of adjustable split clamp locking collar 56 are best seen in FIGS. 5, 6 and 7, wherein shaft 44 is shown supporting and integrally secured within an opening 57 formed in half portion 58 of adjustable collar 56. Adjacent half portion 59 of adjustable collar 56 is preferably integrally formed with its associated half portion 58, but may be manufactured separately and integrally secured thereto.

A smaller shaft 60 forms the leg portion of T-shaped bolt 61 whose head 62 is slidably disposed within elongated slot 63 of collar portion 59. Shaft 60 extends through a connecting rod 65 and terminates at its extremity in a male or external thread (not shown) which matingly engages a locknut 64 (FIG. 3).

Head 62 of bolt 61 is formed with a female thread 66 extending therethrough. A relatively thin capture plate 67 is disposed such that the grooved slotted head 68 of a bolt 69 is captively held for rotary movement. The threaded shank 70 of bolt 69 extends into mating or threaded engagement with thread 66 such that rotary turning of bolt 69 with a screwdriver, for example, will result in movement of head 62 of T-bolt 61 within slot 63 either towards or away from the axis of shaft 44, depending upon the direction of rotation of bolt 69. In the preferred embodiment shown in FIGS. 5–7, the axis of shaft 60 may be moved via adjustment of bolt 69 from a point where same is coaxial with respect to shaft 44 of points eccentric or spaced from same on either side of the axis of shaft 44. In FIG. 6 it can be seen that greater eccentricity can be achieved below the axis of shaft 44 than above, as shown in this FIG. 6. A retaining ring 71 shown in FIGS. 6 and 7 holds T-bolt 61 in the position shown and is provided to aid in assembly and disassembly of collar 56. Capture plate 67 is removably secured to portion 59 by means of two slot-headed bolts 72 and 73 and are accessible to the user's screwdriver or tool in the same way bolt 69 is.

Looking now at FIG. 4, an enlarged view of linkage assembly 35 is shown with connecting rod 65 at its lower end illustrated both in full and phantom lines. The full line illustration of rod 65 represents the adjustment position of shaft 60 when same is coaxial with respect to shaft 44. The reader will note that in this configuration, all links of linkagae assembly 35 extend at right angles with one another with axes 74, 75 and 76 lying along centerline 77. Rotation of shaft 44 during this alignment will result merely in rotation of adjustable collar 56 about the coaxially aligned axes of shafts 44 and 60, with no relative movement as between the links of linkage assembly 35. However, displacement of shaft 60 and the lower end 78 of connecting rod 65 eccentrically from this aligned position to one illustrated in phantom outline, for example, in FIG. 4, will enable a cranking movement of linkage assembly 35 wherein rotation of shaft 44 will cause a predetermined rotary movement of shaft 60 about the axis of shaft 44, and of rollers 20 and 22, as will be described in more detail below. The degree of this adjustable eccentricity as between shafts 44 and 60 will determine the rotary speed of rollers 20 and 22.

Connecting rod 65 extends between a lower end 78, already mentioned, and an upper end 79 thereof. Upper end 79 of connecting rod 65 is pivotally secured to lower forked end 80 of a lower link 81 by means of a pin 82 which extends through leg 83 of forked end 80, thereafter through upper end 79 and through leg 84 of end 80. The reader will recall that shaft 60 has already been described as extending through lower end 78 of connecting rod 65 and preferably is supported by a conventional-type bearaing 85 therewithin.

Lower link 81 extends between its forked end 80 and an upper end 86. Upper end 86 has an irregular structural configuration in that it is forked with two legs 87 and 88, respectively, which terminate substantially perpendicularly with respect to the longitudinal axis of lower link 81. This irregular and right-angle shape of end 86 facilitates the support and accommodation of both a lower shaft 89 carried within a one-way clutch 90, and a connecting pin 91. Lower shaft 89 and clutch 90 cooperate with roller assembly 36 in a manner to be described in detail below. Connecting pin 91, on the other hand, forms an important part of linkage assembly 35 in that it provides a pivotal and rotatable interconnection between lower link 81 and a connecting link 92, as in the case of other elements of this assembly, extends between a lower end 93 through which connecting pin 91 extends, and an upper end 94 through which yet another connecting pin 95 extends. Connecting pin 95 interconnects and provides for relative rotatable movement between connecting link 92 and an upper link 96 forming part of linkage assembly 35. It is a lower end 97 of upper link 96 that is pivotally interconnected with upper end 94 of connecting link 92. Upper link 96 terminates at its upper extremity in a pivotal interconnection between its upper end 98 and an upper shaft 99 supported within a one-way clutch 100, which, as in the case of lower shaft 89 and its associated one-way clutch 90, play an important role in the interconnection between linkage assembly 35 and roller assembly 36.

It is now time to direct our attention more specifically to lower shaft 89, upper shaft 99, and their respective one-way clutches 90 and 100, in order to appreciate how linkage assembly 35 and its component elements physically move with respect to one another and influence both the linkage just described as well as roller assembly 36. In a preferred embodiment of the present invention, upper end 86 of lower link 81 does not directly contact lower shaft 89, but rather frictionally engages and supports the outer race of a lower one-way clutch 90. Lower one-way clutch 90 includes conventional clutch means (not shown) for transmitting one-way rotary motion from its outer race to its associated inner race and lower shaft 89. Similarly, the upper end 98 of upper link 96 is connected to the outer race of upper clutch 100 of the same type and of a conventional and known structure as lower clutch 90. This invention contemplates utilizing conventional and known clutches capable of being purchased in the marketplace known to the trade. However, it is also within the scope of this invention to provide improved clutches for these purposes which accomplish substantially the same or improved results. As has already been described for lower clutch 90, one-way rotary motion is transmitted by the outer race of upper clutch 100 under the influence of upper end 98 to upper shaft 99.

I would now like to direct our attention to the roller assembly 36 with which linkage assembly 35 is associated. A horseshoe-shaped frame member 101 is removably secured to plate 53, which, in turn, is removably secured to mounting plate 32. Frame member 101 includes two depending legs 102 and 103 which straddle a yoke member 104. Yoke member 104 supports an upper roller 105 for rotary movement about a transverse axis which coincides with the axis of upper shaft 99. A lower roller 106 is supported with the aid of depending leg 103 for rotary movement about an axis which coincides with the axis of lower shaft 89. It is depending leg 103 of frame member 101 that actually facilitates the support of lower roller 106. Upper and lower rollers 105 and 106 meet and engage one another in a plane which coincides with the upper surface of sewing machine 31 upon which fabric leaving the needle and sewing foot of machine 31 rests. An extension of this surface, in the form of an optional supporting plate 107, is shown in phantom outline in FIG. 3. Supporting plate 107 may be of any desired or predetermined configuration and preferably is notched to provide clearance for lower roller 106. In this way, fabric may rest upon and be guided by supporting plate 107 while contacted and influenced by the action of upper and lower rollers 105 and 106 between which this fabric passes. It is the presence of these upper and lower rollers 105 and 106 which causes a novel pulling of said fabric after the fabric has left the sewing needle of industrial sewing machine 31.

The outer race of a one-way anti-reverse clutch 108 is frictionally but removably held within an opening in depending leg 103 of the yoke, such that the inner race is frictionally supported by lower shaft 89. Thus, with the relative side-by-side disposition of one-way clutches 100 and 108 reversely mounted upon lower shaft 89, lower roller 106 will only be capable of rotating in one direction, without backlash or slipping. There is no anti-reverse clutch associated with upper shaft 99, according to a preferred embodiment of this invention to accommodate small reverse movement or rotation of upper roller 105 during its being lifted, but not during operation of the puller.

The means by which linkage assembly 35 influences roller assembly 36 is shown in FIG. 4, wherein it is seen that rotation of shaft 44 about its longitudinal axis in synchronization with the sewing machine feed drive results in a rotation of shaft 60 about the axis of shaft 44 when shaft 60 is eccentrically displaced from the axis of shaft 44. The radius of this rotation corresponds to the distance between the centerline of shaft 44 and the centerline of shaft 60. As has already been described, this radius of rotation may be varied and adjusted by manipulation of adjusting screw 68. This rotation of shaft 60 about the axis of shaft 44 also causes a corresponding rotation of the end 78 of connecting rod 65 about this same axis. The result of this latter rotation about the axis of shaft 44 is an oscillating or reciprocating motion of lower link 81 about the axis of lower shaft 89 and its associated lower one-way clutch 90. This reciprocatory motion of lower link 81 is transmitted to upper link 96 by means of connecting link 92. it will be obvious to the reader from FIG. 4 that an identical type of reciprocatory motion is induced in upper link 96 about the axis of upper shaft 99 and its associated upper one-way clutch 100.

In a preferred embodiment of this invention, the distances between the axis of pin 82 and the axes of shafts 60 and 89 are equal. Similarly, the distance between the axis of lower shaft 99 and that of connecting pin 91 is equal to the distance between the axis of upper shaft 99 and connecting pin 95. Due to this particular configuration just described, the angle of oscillation or reciprocation of each of lower link 81 and upper line 96 is the same. This is quite significant when one considers the role played by the lower and upper clutches 90 and 100, respectively, in the transmission of rotary motion to lower and upper roller 105 and 106 of roller assembly 36. One-way but reverse identical synchronized rotary motion induced as a result of the oscillation of reciprocation of lower and upper links 81 and 96 is transmitted via lower and upper clutches 90 and 100 to shafts 89 and 99 associated with lower and upper rollers 106 and 105, respectively. Thus, we are able to see that the adjustable split clamp collar unit 56 which is synchronously driven through timing belt 39 by and with industrial sewing machine 31 transmits and causes oscillation of shaft 60 about the axis of shaft 44. This shaft 60, in turn, causes lower link 81 to drive the upper link 96 through approximately and substantially the same angular displacement, but in an opposite rotational direction, due to the novel geometry presented here. Since, in a preferred embodiment of this invention, the diameters of rollers 87 and 88 are substantially equal, equal but opposite angular rotation and displacement of the rollers is achieved.

The upper shaft 99 is driven intermittently through its associated upper clutch 100 in an harmonic motion during half the cycle, in synchronism with both the lower shaft 89 and the feed mechanism of industrial sewing machine 31. The directions of rotation, which are opposite with respect to one another, of rollers 105 and 106 are shown for shafts 89 and 99 by arrows in FIG. 4.

It is obvious from looking at FIG. 3 that the gearing associated with the prior art mechanism shown in FIG. 1 is eliminated in the present invention. In its place, a positive drive associated with upper and lower rollers is provided. Long shafts and universal joints are eliminated on the output sides of the drive. And yet, other desirable features for handling fabric with the device just described and facilitated, as will become obvious below.

It is desirable to provide the capability of lifting upper roller 105 away from lower roller 106, such as during the times when fabric is loaded between the rollers, for example. Two distinct lifting mechanisms are provided by the present invention, namely, fixed cam lifter 37 and sewing foot lifter 38.

Before specifically describing these lifters, however, other elements and components of roller assembly 36 should be described. Yoke member 104 supports upper roller 105 for rotary movement between bearings 109 and 110 (FIG. 2). Roller 105 is held in contact with roller 106 by means of the biasing of a compression helical spring 111 located between and bearing against upper surfaces 112 of yoke member 104 and lower inside surfaces 113 of frame member 101. Helical spring 111 is positioned by and encircles a rod 114 which carries a locknut 115 as well as two knurled locknuts 116 and 117 which are held together by one another on a threaded portion 118 of rod 114. It is thus possible to adjust the pressure between rollers 105 and 106 by means of manipulation of knurled locknuts 116 and 117 and their associated rod 114.

Fixed cam lifter 37 consists of a cammed lever 119 which is capable of rotation about the axis of a pin 120 supported by frame member 101. Movement of fixed cam lifter 37 and its lever 119 is a clockwise direction from the position shown in FIG. 2 will raise and lock roller 105 and yoke member 104 in a raised position, without raising the sewing foot. By simply swinging lever 119 in the opposite direction in a counterclockwise direction from that just described, roller 105 will be lowered to a position wherein it contacts lower roller 106. An elongated vertical slot 121 formed through leg 103 of frame member 101 facilitates unobstructed movement of upper shaft 99 which extends through this slot 121 towards upper roller 105.

Turning now to the sewing foot lifter 38, an elongated lever 122 is shown in FIGS. 2 and 3 terminating in a substantially horizontal handle portion 123. By depressing lever 122 by means of pressure upon handle portion 123, lever 122 will rotate in a counterclockwise direction downwardly about the axis of a pivot pin 124 extending into frame member 101 to a position shown in phantom outline in FIG. 2. Where the machine operator's hands are being utilized for more important operations, the operator's foot may be used to depress lever 122 by means of the interconnection of a chain 125 secured at its upper end through an opening 126 formed through lever 122. At its lower end, not shown, a conventional foot pedal may be provided. Depression of lever 122 will result in the lifting of the sewing foot associated with industrial sewing machine 31. This is accomplished by means of an adjustable cam assembly 127 associated with lifter 38. Assembly 127 basically consists of a cam plate 128 formed with a projecting bearing finger 129 capable of depressing a foot-lift bar or member linked with the sewing machine sewing foot. The disposition and orientation of plate 128 may be adjusted by means of fasteners 130 which extend through slots 131 formed in lever 122 and into cam plate 128.

This invention contemplates the adjustment of the effective length of one or more of the links comprising the aforesaid linkage assembly. In this way, the speeds of the upper and/or lower rollers may be adjusted and varied with respect to one another for applications including, but not limited to, sewing multi-layered fabrics.

This invention yet further contemplates utilizing an additional braking surface spring-urged against one or either of the output shafts 89 and 99 or one of the output rollers to provide additional overshoot deterrent in cases where higher speeds in the neighborhood of 6,000 cycles per minute may be comfortably achieved.

The embodiments of the invention particularly disclosed and described are presented merely as examples of the invention. Other embodiments, forms and modifications of the invention coming within the proper scope and spirit of the appended claims will, of course, readily suggest themselves to those skilled in the art. An example of this, for example, resides in the ability of the user of the present invention to utilize a flexible shaft drive in place of the specific drive means shown and described above.

The apparatus described above and illustrated in FIGS. 2–4 functions in a manner in which fabric leaving the needle (not shown) of industrial sewing machine 31 is engaged between and pulled forward by cooperating rollers 105 and 106 of roller assembly 36. An important and significant feature of this invention is the fact that fabric is advanced by rollers 105 and 106 only during the period that the sewing machine needle is operating. There is no appreciable operation of rollers 105 and 106 on this sewn fabric at all during the time when the industrial sewing maching is not in operation. This enables a uniform stitch repeatability and stitch size at all times during the operation of puller attachment assembly 30. There is no inertia loading, as in the case of conventional machines. There is no overshooting during deceleration as a result of inertia loading. There is no slippage between the rollers since the material is advanced by the rollers at exactly the same rate that this material is advanced by the industrial sewing machine. However, it is within the scope of this invention to provide a predetermined or desired tension in the fabric between the needle of the sewing machine and the point of contact between rollers 105 and 106 and the sewn fabric. This predetermined tension is available at the option of the user or puller attachment assembly 30 and it is also possible for the user to eliminate this tension entirely. This fabric tension may be varied or eliminated, as stated.

We thus see that a high-speed, low-inertia, gearless, synchronized puller attachment is provided by the present invention in such a way as to permit high-speed indexing as a result of the cooperative interengagement of an adjustable linkage assembly which influences and drives rollers in a synchronized harmonic motion.

What is claimed is:

1. A puller attachment for use with fabric handling apparatus such as a sewing machine, or the like, comprising: roller means for receiving fabric sewn and discharged by the operation of said sewing machine and urging said fabric in a forward direction, said roller means including upper and lower cooperative rollers supported by upper and lower drive output shafts, respectively; drive means interconnecting a drive mechanism of said sewing machine and said upper and lower rollers, said drive means synchronously responsive to the operation of said sewing machine for causing substantially synchronous identical angular displacement of said upper and lower rollers substantially only during periods of sewing machine operation, said drive means including a linkage assembly disposed adjacent and cooperatively interconnected with said roller means, said drive means imparting one-way rotary movement to each of said upper and lower rollers during said periods of sewing machine operation, and clutch means interconnecting said linkage assembly and each of said upper and lower drive output shafts for permitting the angular displacement of each of said upper and lower rollers in one direction only during operation of said puller attachment, said clutch means including an upper clutch mounted upon said upper drive output shaft and a lower clutch mounted upon said lower drive output shaft; and lift means cooperatively connected to said upper drive output shaft for separating said upper and lower rollers from one another.

2. A puller attachment, according to claim 1, characterized by the absence of gears.

3. A puller attachment, according to claim 1, further including means for adjusting the angular displacement of said upper and lower rollers.

4. A puller attachment, according to claim 1, wherein said drive means further includes a flexible drive shaft.

5. A puller attachment, according to claim 1, further comprising means for maintaining a predetermined tension in said sewn fabric as it is received by said roller means.

6. A puller attachment, according to claim 1, wherein each of said upper and lower cooperative rollers include outer bearing surfaces, the speed of said bearing surfaces during operation of said sewing machine corresponding to the speed of said sewn fabric discharged by the operation of said sewing machine.

7. A puller attachment, according to claim 1, wherein said clutch means comprises at least one one-way clutch cooperative with said lower roller.

8. A puller attachment, according to claim 7, wherein said clutch means comprises three one-way clutches.

9. A puller attachment, according to claim 1, wherein said linkage assembly comprises a plurality of arm members positively interconnecting said upper and lower rollers such that movement of said lower roller will necessarily cause substantially corresponding movement of said upper roller.

10. A puller attachment, according to claim 1, wherein said linkage assembly comprises a plurality of arm members positively interconnecting said upper and lower rollers such that movement of said lower roller will necessarily cause substantially corresponding movement of said upper roller.

11. A puller attachment, according to claim 10, wherein said plurality of arm members are each of a predetermined length with respect to the lengths of the other of said arm members.

12. A puller attachment, according to claim 10, further comprising means for adjusting the lengths of at least one of said plurality of arm members.

13. A puller attachment, according to claim 1, wherein said clutch means comprises a lower one-way clutch cooperatively associated with said lower shaft, and anti-reverse one-way clutch cooperatively associated with said lower shaft, and an upper one-way clutch cooperatively associated with said upper shaft.

14. A puller attachment, according to claim 1, further comprising a timing belt responsive to the sewing machine drive and synchronously influencing said linkage assembly.

15. A puller attachment, according to claim 1, further comprising friction means for increasing the inertia of said puller attachment.

* * * * *